United States Patent [19]

Gehring et al.

[11] 4,369,815

[45] Jan. 25, 1983

[54] DEVICE FOR COUPLING A HEDDLE FRAME TO VERTICALLY RECIPROCATING DRIVE BARS

[75] Inventors: Fritz Gehring, Lindau-Bodolz; Florian Windischbauer, Haslach; Horst Häussler, Lindau, all of Fed. Rep. of Germany

[73] Assignee: Lindauer Dornier Gesellschaft mbH, Fed. Rep. of Germany

[21] Appl. No.: 179,165

[22] Filed: Aug. 18, 1980

[30] Foreign Application Priority Data

Aug. 21, 1979 [DE] Fed. Rep. of Germany ..... 2933699

[51] Int. Cl.[3] ..... D03C 13/00; D03C 9/06

[52] U.S. Cl. ..... 139/57; 139/82

[58] Field of Search ..... 139/82, 83, 84, 88, 139/57, 58; 403/209, 327, 333

[56] References Cited

U.S. PATENT DOCUMENTS 4,083,385 4/1978 Pfarrwaller ..... 139/57

FOREIGN PATENT DOCUMENTS 2201812 6/1973 Fed. Rep. of Germany ..... 139/57

2408672 6/1979 France ..... 139/57

740875 6/1980 U.S.S.R. ..... 139/82

*Primary Examiner*—James Kee Chi

*Attorney, Agent, or Firm*—James E. Bryan

[57] ABSTRACT

This invention relates to an improvement in a device for coupling a heddle frame to reciprocatable drive bars with a first coupling part mounted on the frame of the heddle and with a second coupling part mounted to a drive bar, one of the coupling parts comprising drive means insertable between two parallel wall parts of the other coupling part, the coupling parts acting together by means of drive surfaces arranged transversely to the drive direction of the drive bar, the improvement which comprises the drive means being a hook-shaped element having wedging surfaces extending essentially transversely to the main direction of force of the drive bar and diverging toward the hook opening, a shaped element supported by a bearing in order to be limited in rotation positioned between the wall parts and provided with correspondingly located mating wedging surfaces adapted to be received in the hook-shaped element, means for pivoting the drive bar, together with the coupling part thereon, in the plane of the heddle frame to engage the other coupling part, and means for locking the coupling parts together in the plane.

3 Claims, 2 Drawing Figures

DEVICE FOR COUPLING A HEDDLE FRAME TO VERTICALLY RECIPROCATING DRIVE BARS

The invention relates to a device for coupling heddle frames to vertically reciprocating drive bars.

An important procedure in weaving is the coupling of the heddle frames of a loom to the drive mechanism in order to ensure the shedding of the loom. Each individual heddle frame therefore must be provided with its own separate connection to the drive mechanism by means of drive bars, for instance to a dobby. Many appropriate designs are known. As a rule, the drive bars engage the lower beam of a heddle frame.

In known devices of this kind, the ends of the drive bars are individually mounted into associated receiving fittings at the heddle frame. When a number of frames are used in a loom, this model has the drawback of a long set-up time. Furthermore, assembly requires a certain mounting play for elements with the coupling location at the bearing of the drive bars, whereby the bearings may be worn out and undesired oscillation of the heddle frames may result.

Another known means for coupling the drive bars is disclosed in German Offenlegungsschrift No. 2,656,380, in that the drive bars are designed as claws, the two elastic bar parts permitting spreading by rotating a lever passing transversely through all the drive bars for the purpose of coupling. Due to the elastic connection of the claws, it is questionable as regards this design whether a reliable force-transmission free of play can be achieved.

These drawbacks for the first time are eliminated in part by the device disclosed in German Auslegeschrift No. 2,609,964. This is accomplished in that a first coupling component is provided at a beam of the heddle frame and a second coupling component at the drive bar. One of the drive components is provided with a catch inserted between two wall parts of the other coupling component. The two wall parts are a part of a sleeve-shaped component and form a channel into which the catch means can be inserted from above. The catch means is made to engage a claw shaped or toothed coupling component inside the sleeve by displacing the heddle frame sideways. There is no special locking of the parts mutually engaged, rather, it is the sideways guidance of the heddle frame in the machine together with drive bars also guided sideways in the loom which must ensure the coupling. While rapid coupling between the heddle frame and the associated drive bars is achieved in this manner, the drive bars must be appropriately supported or fixed in position to absorb the coupling forces, whereby the cited special guide means and additional crankrod-like coupling members between the drive bars and direction-changing levers of the drive mechanism becomes necessary. The high cost in construction thus resulting entails high financial costs, and the additional transmission members furthermore tend to oscillate.

The present invention presupposes devices of the last-cited kind, that is, couplings with one coupling part at the heddle frame and one coupling part at the drive bar, one of these coupling parts comprising a driver which can be inserted between two parallel walls of the other coupling part. The basic object is to create a coupling between the heddle frame and the drive bar that will ensure an easily handled and play-free connection, and that will consist of simple, easily manufactured parts.

The problem is solved by the invention in that:

(a) the driver is designed as a hook-shaped element with wedging surfaces extending transversely to the main direction of force of the drive bars and diverging toward the hook opening, (b) a shaped piece receiving the hook-shaped element and provided with corresponding mating wedging surfaces is supported between the wall parts so as to be rotatable in a restricted manner, and (c) the coupling member mounted to the drive bar is pivotal together with the bar in the plane of the heddle frame in order to engage the other coupling member, and can be locked in that position.

The diverging partial surfaces extending transversely to the main direction of the force ensure that when the two coupling parts are pivoted inwardly and together with the rotatable shaped piece, there will be play-free transmission of force from the drive bar to the heddle frame. The actual rotational support mandatory for operation is provided in the shaped piece itself. Therefore, the crankrod-shaped coupling member that is required in the cited previously known coupling means is eliminated in this case.

In a further design of the invention, the shaped piece also comprises another wedging surface extending approximately parallel to the main direction of the force and preferably even with a curved path. Together with a spring-loaded locking pawl mounted at the other coupling part, the wedging surfaces of the two coupling parts are so clamped mutually that clamping transversely to the main direction of the force is ensured and no adverse play is present between the coupling parts.

Another advantage of the device of the invention is that when pivoting the drive bars into the frame fittings, the locking pawls latch automatically and therefore manipulation of the individual coupling components is eliminated, whereby operation is substantially facilitated. The unlocking takes place simultaneously for all heddle frames by means of a slider passing transversely through a cut-out in the receiving fittings, the pawls being opened and the drive bars being released. Obviously, individual unlocking is possible in addition.

To ensure that the shaped piece at the one coupling part can be reliably inserted into the hook-shaped element at the other coupling part, provision is made for a stop or similar component, whereby the range of rotation of the shaped piece is restricted to the scope required for active operation.

Regarding the manufacturing cost of the device of the invention, the low number of simple individual parts results in low costs. Special parts to hold or guide the drive bars during the coupling process are not required.

It is immaterial to the essence of the invention which coupling part is associated to the heddle frame. For instance, the first coupling part can be mounted together with the hook-shaped element to a beam of the heddle frame, and the shaped piece of the second coupling part can be mounted rotatably to the drive bar or vice-versa. The number of required components and the coupling process itself remain unchanged. The quality of the drive connections so established also remains unaffected.

An illustrative embodiment of the invention is described below in relation to the drawing, in which.

Figure 1:
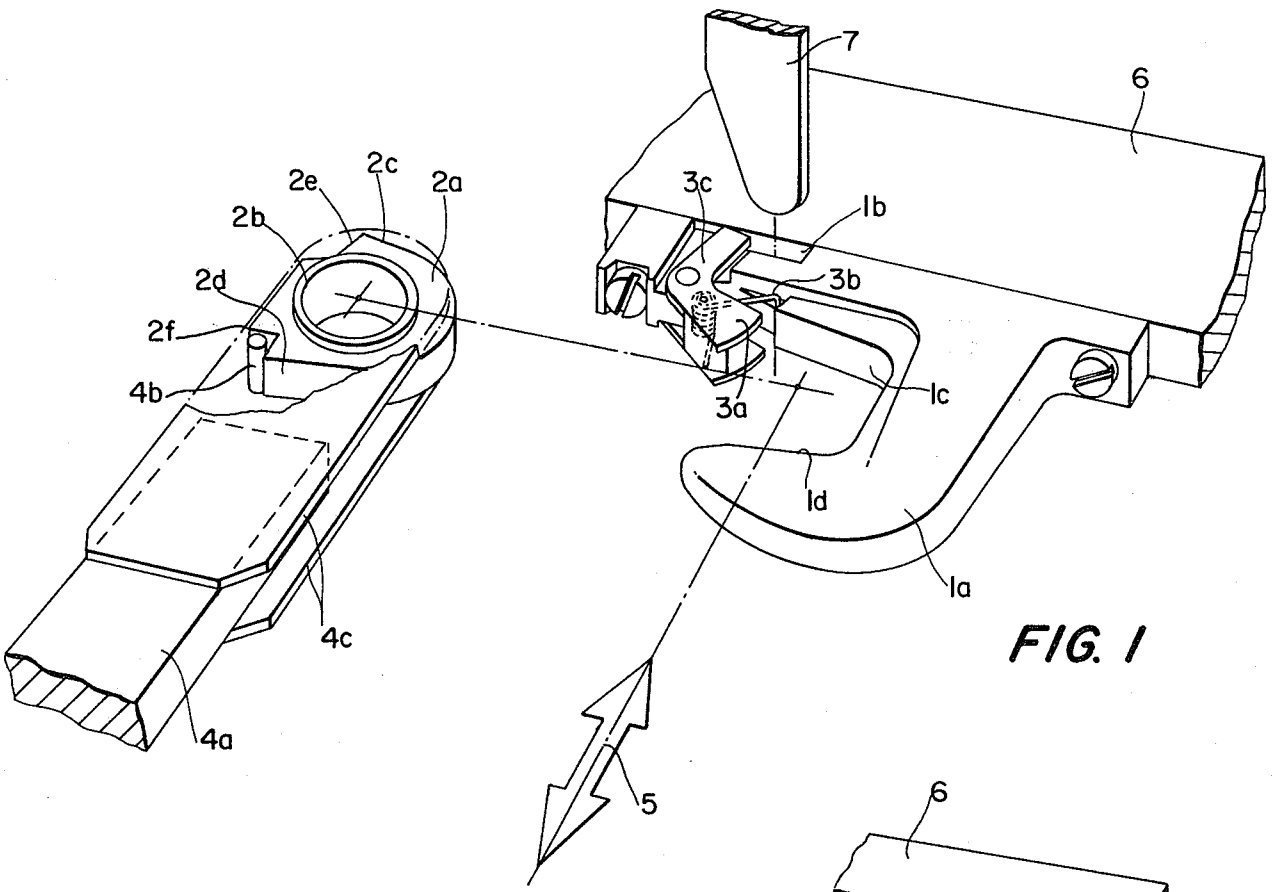
FIG. 1 is a perspective of the overall device.

The drawing shows only the coupling parts themselves and for the sake of clarity, their arrangement within a loom is omitted. The beam of a heddle frame is denoted by 6. To this beam is mounted the first coupling part 1*a*, which is designed like a hook with two wedging surfaces 1*c* and 1*d*. These two wedging surfaces run approximately transversely to the main direction 5 of the force and diverge with respect to the direction of the hook. The hook opening points in the direction of the heddle frame beam. As a matching component for the first coupling part, the second coupling part is mounted to a drive bar 4*a*. The second coupling part is composed of two wall parts 4*c* which extend parallel to and in extension of the drive bar 4*a*. For the sake of clarity, one of the wall parts is shown partially broken away. A shaped piece 2*a* is rotatably supported between the two wall parts. The support is indicated by the bearing ring 2*b*. The shaped piece 2*a* has wedging surfaces 2*c* and 2*d* corresponding to the wedging surfaces 1*c* and 1*d* of the hook-shaped element. The coupling motion of the two coupling parts is indicated by the dot-dash lines between the hook 1*a* and the shaped piece 2*a*. The coupling itself takes place for instance by pivoting the drive bar 4*a* into the coupling part, held fixed, of the heddle frame 6.

After the two coupling parts 1*a* and 2*a* are joined, these two components are automatically locked by a locking pawl 3*a*. The locking pawl 3*a* is spring-loaded as indicated by the spring 3*b*. The locking pawl 3*a* together with a further wedging surface 2*e* acts on the shaped piece 2*a*. The wedging surface 2*e* runs about parallel to the main direction 5 of the force of the drive bar. This wedging surface instead of being straight also can be curved toward the locking pawl 3*a*, in a concave manner. The centers of rotation and curvature of the locking pawl 3*a* and wedging surface 2*e* respectively are different, so that these two components provide clamping of the first coupling part 1*a* to the shaped piece 2*a* and play-free seating in the main direction 5 of the force. No securing pin or connecting pin passing through the device is at all required.

In order that there be no difficulties when the two coupling parts are coupled, the rotation of the shaped piece 2*a* about the bearing 2*b* is limited. To that end a recess 2*f* is provided in the shaped piece 2*a* and a pin 4*b* is provided as a stop means between the two wall parts 4*c*. The faces of the recess 2*f* together with the pin 4*b* limit the rotation of the shaped piece 2*a* to that range required for the functioning of the drive bar 4*a* during operation.

A passage 1*b* is provided at the hook-shaped element 1*a* to unlock the two coupling parts. Part of the locking pawl 3*a*, for instance the surmounting arm 3*c*, in the locked position covers the passage 1*b*. To unlock, a slide means 7 with a tapered end is introduced into the passage 1*b*. In this process, the slide means displaces the arm 3*c* of the locking pawl 3*a* and thus unlocks it. When all the heddle frames 6 of a loom are at the same height and all the fittings are aligned with their passages 1*b*, all the frames can be unlocked together. The unlocking of course can also take place in a variation of the same principle. Thus, in lieu of the passage 1*b* acting as a guide means for the slider 7, a guide means for the slider, for instance in the form of a protruding beak or the like, may be provided at the hook-shaped element 1*a* at the other coupling part, for instance at the drive bar 4*a* or at the wall parts 4*c*.

It is equally feasible to simultaneously apply all the coupling parts to all the heddle frames, or to separate the coupling parts, for instance by actuation bars similar to the slide means 7 and passing transversely through the set of all the heddle frames, by simultaneously pivoting for instance all the drive bars 4*a*; this variation is not shown in further detail.

Figure 2:
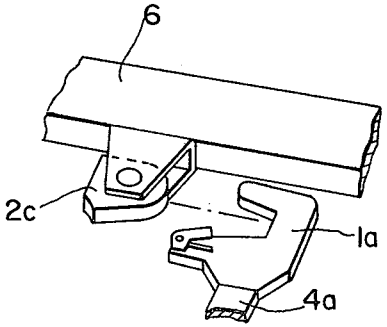
FIG. 2 is a variation of the device.

FIG. 2 is a sketch of the basic principle of the invention, except that in this case, there is the difference of interchanging the arrangement of the two coupling parts 1*a* and 2*a* at the heddle frame 6 and drive bar 4*a* respectively compared to the embodiment of FIG. 1.

It will be obvious to those skilled in the art that many modifications may be made within the scope of the present invention without departing from the spirit thereof, and the invention includes all such modifications.

What we claim is:

1. In a suspension device for the heddle frame motion at heddle frames with a first coupling part designed as a hook with a mouth tapering in a wedge-like manner, and with a second rotatably supported coupling part designed as a mating piece with corresponding wedge-surfaces and spanned by the mouth of the hook, the improvement comprising a pivotal, spring-loaded locking pawl adapted to be overridden by a wedge-like surface of the rotatable mating piece mounting to the hook-shaped coupling part, and a curved recess provided as a latching means for the locking pawl at the widened end of the wedge-like surface of the mating piece, different positions being assumed in the locked position by the center of rotation of the locking pawl and the center of curvature of the recess, whereby when pivoting the locking pawl, bracing takes place between the locking pawl and the mating piece.

2. A device according to claim 1 including guide means in one of said coupling parts, and slide means adapted to be inserted into said guide means to unlock the locking pawl.

3. A device according to claim 2 including a common slide means adapted to be inserted into a plurality of guide means to unlock the couplings of a plurality of sequentially aligned heddle frames.

* * * * *